United States Patent [19]

Felstehausen

[11] Patent Number: 4,530,264

[45] Date of Patent: Jul. 23, 1985

[54] CARRIER CUTTING WHEEL

[75] Inventor: Eugene F. Felstehausen, Hoopeston, Ill.

[73] Assignee: Illinois Tool Works Inc., Chicago, Ill.

[21] Appl. No.: 509,565

[22] Filed: Jun. 30, 1983

[51] Int. Cl.[3] ..... B26D 1/62

[52] U.S. Cl. ..... 83/175; 83/308; 83/337

[58] Field of Search ..... 83/308, 337, 54, 175; 53/48, 398

[56] References Cited

U.S. PATENT DOCUMENTS

| | | | |
|---|---|---|---|
| 563,252 | 7/1896 | Bensing | 83/308 X |
| 2,629,341 | 2/1953 | Rice | 83/308 |
| 3,204,386 | 9/1965 | Creed et al. | 53/48 |
| 3,724,307 | 4/1973 | Johnson | 83/337 |
| 3,742,677 | 7/1973 | Best | 53/48 X |
| 3,807,117 | 4/1974 | Abrams | 53/48 X |
| 3,901,113 | 8/1975 | Oltmanns et al. | 83/54 X |
| 3,910,713 | 10/1975 | Maroschak | 83/54 X |

*Primary Examiner*—Frank T. Yost

[57] ABSTRACT

A cutter wheel is provided having a plurality of spokes thereon interfitting with successive apertures in a continuous strip of plastic material assembled with cans, such as beverage cans, and having spaced cutting blades thereon for severing the plastic strip at spaced intervals to produce discreet packages, i.e., "six packs". The wheel is driven by the strip and overlies the strip, lying in a plane parallel to the direction of motion of the strip and assembled can. Each spoke is offset from a radial position so that a spoke is upstream from a radial line perpendicular to the strip when such spoke reaches a vertical position perpendicular to the strip for the associated cutter to effect its cut.

14 Claims, 7 Drawing Figures

FIG. 4
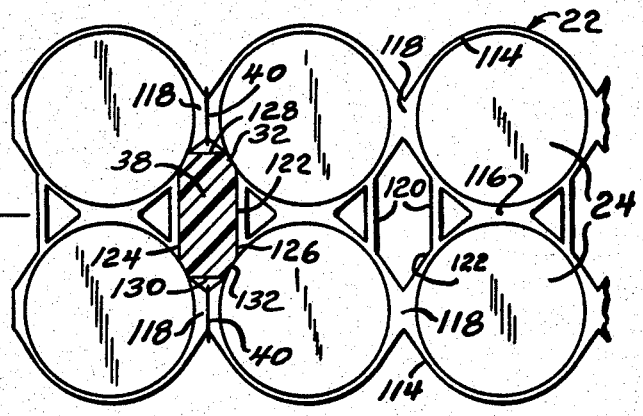
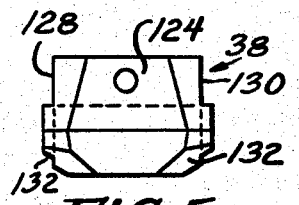
FIG. 5
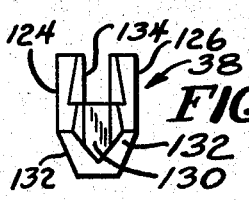
FIG. 6
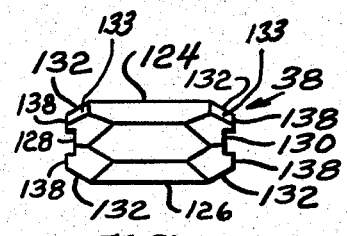
FIG. 7
FIG. 3
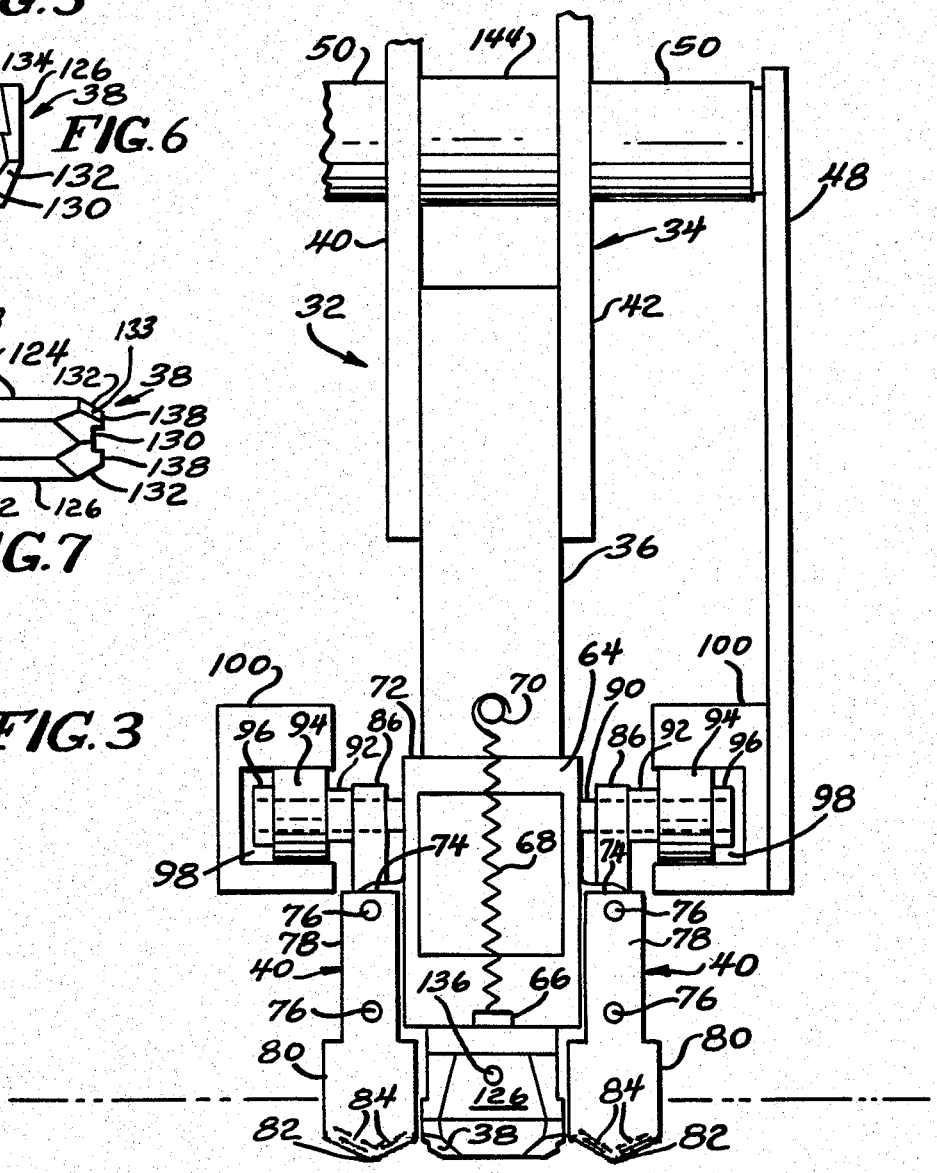

CARRIER CUTTING WHEEL

BACKGROUND OF THE INVENTION

It is common practice both in the patent arts and in commerce to package a plurality of cans or the like containers by means of an apertured plastic sheet stretched over the cans and gripping beneath the beads at the top thereof. Typically, six or sometimes eight, cans of beer or soft drink are so packaged and are commonly known as a "siz pack". Although the plastic carriers grip the cans tenaciously it is a simple matter to remove a can by pulling it sideways to stretch the material around the respective aperture, and then to tip the can to remove it from the carrier.

Automatic machinery has been developed for assembling the cans with the plastic carriers. A continuous strip of apertured sheet plastic is fed to an assembling station along with two (or sometimes three) rows of cans for assembly of the cans with the continuous carrier strip. Such assembly machines are shown, for example, in U.S. Pat. Nos. 3,816,968 and 4,250,682. Subsequent to the assembling of the carrier or strip with the cans it is necessary to sever the carrier at spaced intervals to produce the desired "six pack".

Prior art cutters for severing the strip or carrier have often been located to one side of the strip and substantially in the plane thereof as in U.S. Pat. Nos. 3,204,386 and 3,991,640. In some instances the cutter has been disposed above the strip and disposed diagonally of the path of travel thereof. Such a cutter is shown in U.S. Pat. No. 3,991,640. Prior art cutters have often required very accurate and hence expensive gearing for driving the cutters in synchronism with the movement of the strip and cans.

OBJECTS AND SUMMARY OF THE PRESENT INVENTION

It is an object of the present invention to provide a cutter for severing a strip assembled with a plurality of cans, which cutter may be driven by the strip itself and therefore requires no synchronizing gearing or the like.

It is further an object of the present invention to provide a cutter wheel disposed above and perpendicular to the plane of the carrier device or strip having a plurality of cans assembled therewith and lying in a plane parallel to the direction of movement of said strip.

Yet another object of the present invention is to provide a cutter wheel for a plastic web assembled with a plurality of cans which cutter wheel carries a plurality of cutting blades for simultaneously severing a plurality of points of attachment of successive sections of said strip.

In carrying out the foregoing and other objects of the present invention a succession of cans is assembled with a continuous strip of apertured plastic sheet material. The cans are fed from the assembling machine to a cutting station at which there is located a cutter wheel having a plurality of spokes extending therefrom. Each spoke carries an adapter or end piece interfitting with an aperture in the strip for turning of the wheel in precise synchronism with the movement of the strip. The wheel is disposed above the strip and lies in a plane parallel to the direction of movement of the strip. Each spoke carries a plurality of cutting blades, two in the illustrative example hereinafter set forth, for simultaneously severing a plurality of points of attachment between succeeding "six packs".

DRAWING DESCRIPTION

The invention will best be understood by the following detailed disclosure when taken in connection with the accompanying drawings wherein:

FIG. 3 is an end view from the right side of FIG. 2;

FIG. 4 is a top view partially in section showing the cooperation of one of the teeth or adapters on the cutter wheel with the strip;

FIG. 5 is a front or face view of one of the teeth;

FIG. 6 is a side view thereof; and

FIG. 7 is an end view thereof.

DETAILED DISCLOSURE OF THE ILLUSTRATIVE EMBODIMENT

Figure 1:
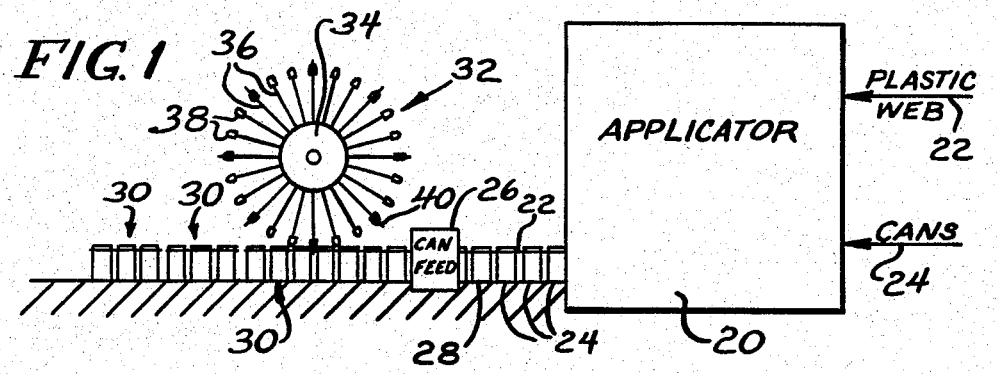
FIG. 1 is a somewhat schematic side view illustrating a carrier cutting wheel constructed in accordance with the principles of the present invention.

Referring now to the drawings in greater detail, and first to FIG. 1 there is shown in "black box" fashion an applicator machine 20 receiving a plastic trip at 22, and a plurality of cans at 24. The plastic strip is a continuous length having pairs of apertures therein for receiving the cans. Such machines are well known and need not be shown in detail, and can be the same as or simiar to those in U.S. Pat. Nos. 3,816,968 or 4,250,682.

Proceeding to the left from the applicator 20 the assembled strip 22 and cans 24 are fed to the left by a can feed device 26 of known type. This can be, for example, star wheels lying on opposite sides of the path and engaging the cans to slide them along a supporting surface 28. This feed device can also be located within the applicator 20. Six packs of cans 30 are subsequently separated from the continuous strip through severing of the strip by means of a cutoff wheel 32 forming the subject matter of the present invention. The wheel as shown generally in FIG. 1 includes a central hub 34 with a plurality of spokes 36 extending outwardly therefrom. The spokes do not lie on radii as will be apparently shortly hereinafter.

Each spoke carries at its outer end a plastic tooth 38, subsequent teeth interfitting with apertures in the strip for turning of the wheel 32. Every third spoke, for a 6-pack embodiment, has a pair of cutter blades 40 thereon, as also will be detailed hereinafter. For exemplary purposes the blades 40 are shown as extending outwardly beyond the teeth 38, and this comprises an exageration as will be clear shortly hereinafter. It should be apparent that the package desired. e.g. 4, 6, 8 pack will dictate the placement of the cutter blades on every 2nd, 3rd or 4th spoke.

Figure 2:
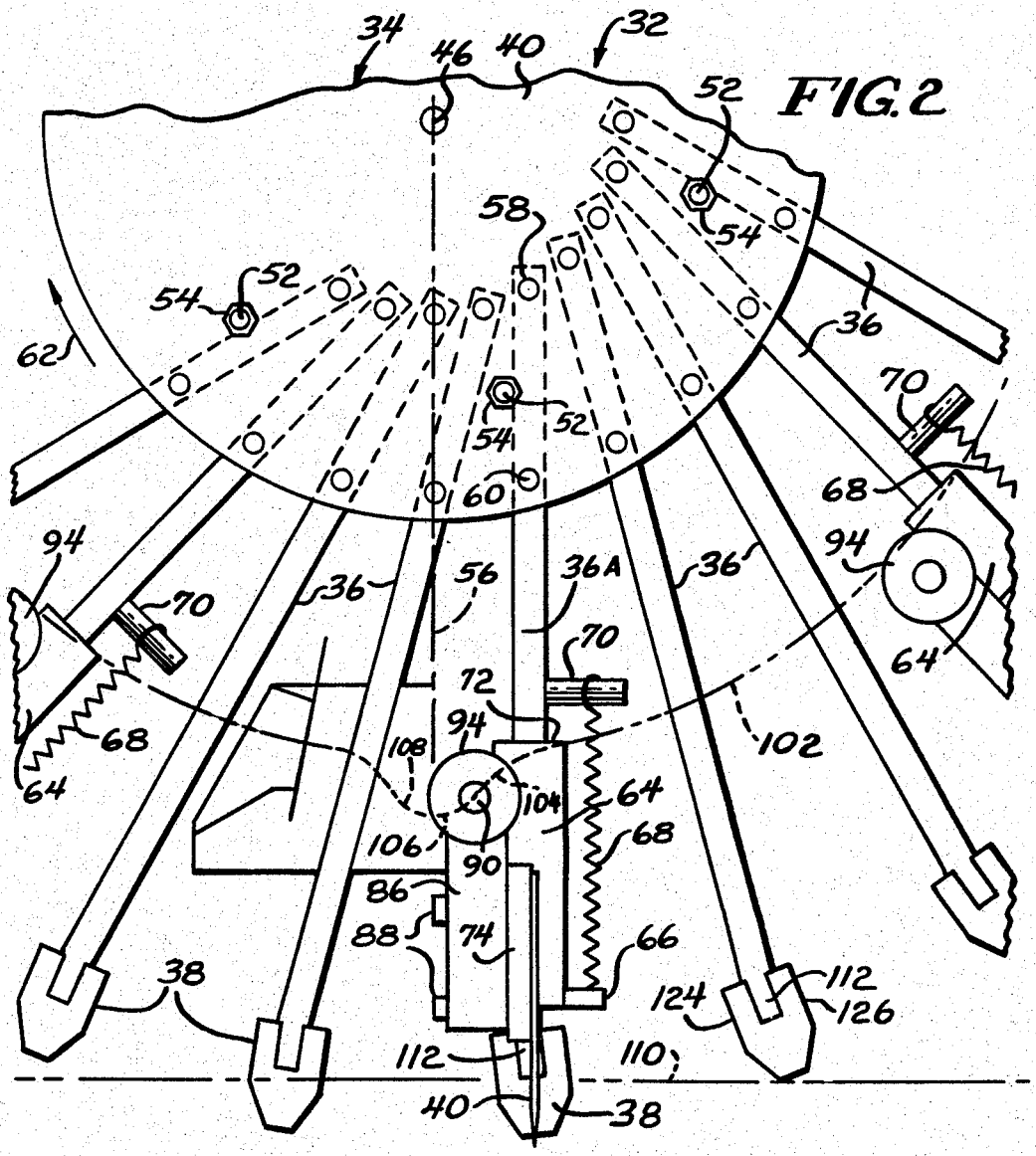
FIG. 2 is an enlarged side view of a portion of the cutting wheel.

Attention should now be directed to FIGS. 2 and 3 wherein it will be seen that the hub 34 comprises a pair of similar spaced plates 40 and 42. The plates are spaced by a cylinder 44 encircling a shaft 46 rotatably mounting the wheel 32 from suitable supports such as side plates 48. Additional cylindrical spacers 50 space the plates 40 and 42 from the support means. The plates 40 and 42 further are spaced by the struts 36 which are disposed between them, and which are of rectangular cross-section, being considerably longer in an axial direction than at right angles thereto. The plates are secured together by six equally angularly spaced bolts 52 extending through the plates and having nuts 54 thereon.

It has been noted heretofore that the spokes 36 are not quite radially arranged. This best can be seen with reference to FIG. 2, wherein the spoke 36A may be seen to be parallel to a vertical radius 56. The spoke 36A is located upstream of the radius 56 and is secured between the plates 40 and 42 by a pair of fasteners 58 and 60. The fasteners preferably comprise headed screw fasteners having socket-type drives with the heads recessed in the plate 40 and having the opposite ends threaded into apertures in the plate 42. There are 24 spokes 36, and hence there are 24 fasteners 58 equally arcuately spaced about the hub 34 on a common radius. Similarly, there are 24 equally arcuately spaced fasteners 60 spaced about the hubs on another common radius. Accordingly, each successive spoke 36 attains a vertical position before it reaches the vertical radius 56, the direction of rotation being clockwise as indicated by the arrow 62.

The spoke 36A carries a cutter or blade 40, and a similar cutter or blade is carried by each third spoke thereafter. There are actually two such blades 40 as may be seen in FIG. 3, and these blades are mounted for reciprocation relative to the respective spoke 36. A rectangular frame 64 embraces the outer portion of each third spoke 36 and has a trailing flange 66 with an aperture therein. A spring 68 is stretched between the aperture and a stud 70 extending from the respective spoke 36 in the trailing direction. The spring normally urges the upper edge 72 of the frame 64 substantially radially inwardly into engagement with the corresponding stud 70.

The frame is provided with a pair of oppositely axially extending flanges 74 to which the cutter blades 40 are secured by means such as headed screw fasteners 76 extending through the blades and threaded into apertures in the flanges 74. Each blade 40 includes a shank 78 and a wider cutting head 80 extending generally radially outwardly from the shank 78. The outer, cutting edge of the head 80 has a centrally disposed sharp tip 82, and tapered cutting edges 84 extend to either side thereof.

A pair of blocks 86 is secured to the back sides of the flanges 74 respectfully by means of bolts 88 passing through the blocks and threaded into tapped apertures in the flanges. The blocks 86 are provided with aligned apertures supporting a shaft 90 extending at either end outwardly of the cutter blades 40. Cylindrical spacers 92 are provided on the shaft outwardly of the respective blocks 86, and cam follower rollers 94 are provided on the shaft outwardly of the spacers 92. Retainers 96 in the form of collars are secured on the outer rims of the shaft by suitable means such as set screws (not shown). The cam follower rollers 94 and spacers 92 preferably are made of a suitable resinous plastic material such as acetal resin sold under the proprietary name of Delrin.

The cam follower rollers 94 are respectively received in cam tracks 98 in fixed members 100 supported by suitable means such as being secured to the side plate or plates 48. The cam tracks need not extend over the entire annular path over which the rollers 94 travel, since only a short portion of this path is active. The position of the rollers 94 is indicated by the broken line 102 in FIG. 2. It will be seen that most of this line lies on a circle, but that there is an outwardly protruding portion 104 of the path followed by a broad high portion 106 and a return portion 108 to the circular portion 102. The path 102 represents the center position of the shaft 90, and over most of the length of the path 102 the upper edge 72 of the frame 64 abuts the stud 70 under the tension force of the spring 68. However, when the active portion of the cam path 104, 106, and 108 is encountered by the rollers 94 the frame 64 and hence the cutter blades 40 are projected down to the position shown in FIGS. 2 and 3, and subsequently slightly past that position. The path of the tops of the cans 24 is indicated by the broken line 110. In the position shown in FIG. 2 with the spoke 36A in vertical position the tip of the cutting blade is extended about 0.65 inch below the top of the can line 110. The cut is basically complete by this time. The cut starts with the sharp tip 68 of the cutter blade penetrating the plastic strip, and continues outwardly in either direction therefrom outwardly and upwardly along the cutting edges 84.

As may be seen in FIG. 2 the outer tips 112 of the spokes 36 are of reduced thickness and are deflected a few degrees in a trailing position. This deflection can be produced by bending of the reduced thickness end portion 112, or it may be produced without bending through machining of the end of the spoke 36. Each plastic tooth or adapted 38 is mounted on one of the reduced portions 112, and the shape of a tooth may be seen in FIGS. 5–7 as well as in FIGS. 2 and 3. Each tooth is made of a suitable resinous plastic such as the acetal resin known as Delrin.

The shape of the plastic strip carrier device 22 is shown in outline in FIG. 4 as assembled with a plurality of cans 24. The strip comprises laterally aligned pairs of rings 114 joined to one another by restricted web sections 116. Successive pairs of rings are joined to one another longitudinally by web sections 118, and it is selected ones of these sections that are severed to separate the assembled strip and cans into six packs. Besides the restricted web portions 116 joining lateral pairs of rings there are connecting transverse bars 120 extending between the rings. The bars 120 and adjacent portions of four can rings 114 together define a transversely elongated hexagonal aperture 122. As shown adjacent the left portion of FIG. 4 the tooth 38 with which cutters 40 are associated fits in an aperture 122. Successive teeth fit in successive apertures 122. Since the cans are driven by the can feed mechanism 26 the strip is carried forwardly (to the left in FIG. 4), and thus to drive the cutter wheel 32. Each time one of the teeth 38 associated with a cutter is received in an aperture 122 and the cutters 40 are extended as previously set forth the narrow connecting plastic sections 18 are severed, thereby to separate successive six packs.

All of the teeth 38 are of identical construction, and each has a front face 124 and a rear face 126 parallel to one another, and of generally rectangular outline. The rectangular outline is completed by opposite end faces 128 and 130, thereby completing a sectional view (FIGS. 4 and 7) which is generally rectangular in nature. Beveled corners are provided at 132 which also taper inwardly at the lower portion and toward the top to facilitate interfitting of the tooth with the apertures 122. The forward portion of each tooth (in the direction of motion) is provided adjacent the bevelled corners with short facet surfaces 133 which facilitate entry of the tooth into the aperture 122 of the strip. There is no counterpart to the short facets adjacent the trailing end of the tooth, whereby the tooth is nonsymmetrical. This aids the tooth in entering the aperture 122 and in wedging against the cans to tighten the web 118 at or near the instant at which the web is severed. The tightened web is more readily severed and the cutting is more uniform and accurate. Greater cutting blade life also is to be anticipated.

The top portion of the tooth is notched at 134 to receive the extension portion 112 of the respective spoke 136, and a pin 135 (FIG. 3) extends through aligned apertures in the extension portion and in the front and back faces of the tooth. As is best seen in FIG. 7, the tapered surfaces 132 extend beyond the end wall 128 and 130, forming extensions 138. The shape of each tooth is such as to facilitate entry of successive teeth into the successive apertures 122 without any damage to the plastic strip 22, the plastic nature of the teeth enhancing such entry without damage. The nonsymmetry of each tooth guides each tooth into contact with the desired rim portions of the cans to effect tightening of the web for cutting.

The angular disposition of the respective spokes away from radial direction facilitates cutting of the plastic strip by a movement substantially perpendicular to the strip, thereby insuring cutting at exactly the location desired. The sharp point of each cutter blade insures initial penetration of the plastic strip, while the concave cutting surfaces outwardly thereof facilitate subsequent severing of the plastic material.

The specific example of the invention as herein shown and described is for illustrative purposes only. Various changes in the structure will no doubt occur to those skilled in the art, and will be understood as forming a part of the present invention insofar as they fall within the spirit and scope of the appended claims.

The invention is claimed as follows:

1. A carrier cutting wheel for severing at spaced intervals a moving plastic strip assembled with a plurality of containers, said strip having spaced apertures therein intermediate said containers, said wheel comprising a hub having means for rotatably mounting said wheel, a plurality of spaced projections from said hub shaped to interfit sequentially with said strip apertures, said wheel thereby capable of being driven by said strip, and cutting means disposed adjacent certain of said projections for severing said strip at spaced intervals, wherein each projection is skewed relative to a respective radius whereby each projection becomes perpendicular to said strip upstream of a radius of such wheel perpendicular to said strip.

2. A cutting wheel as set forth in claim 1 wherein said wheel is disposed substantially in a plane perpendicular to said strip and parallel to the direction of movement thereof.

3. A cutting wheel as set forth in claim 2 and further including means for advancing said cutting means substantially perpendicular to said strip for effecting severing thereof.

4. A cutting wheel as set forth in claim 2 wherein said projections comprise spokes equally arcuately spaced about said wheel, and wherein said cutting means are mounted for advancement and retraction substantially parallel to respective spokes.

5. A cutting wheel as set forth in claim 2 wherein said strip comprises a plurality of parallel rings longitudinally interconnected by restricted sections, and wherein said cutting means has a like plurality of cutting blades for severing said restricted sections.

6. A cutting wheel as set forth in claim 5 and further including means for advancing said cutting means substantially perpendicular to said strip, said advancing means simultaneously advancing all of the cutting blades associated with a respective projection.

7. A cutting wheel as set forth in claim 1 wherein said projections comprise spokes equally arcuately spaced about said wheel, and wherein said cutting means are mounted for advancement and retraction substantially parallel to respective spokes.

8. A carrier cutting wheel in combination with a plastic strip assembled with a plurality of container means for rotatably mounting said wheel, means for rotating said wheel in timed relation with the movement of said plastic strip, said cutting wheel lying above and substantially in a plane perpendicular to said strip and parallel to the direction of movement thereof, a plurality of spaced projections carried by said cutting wheel in arcuately spaced positions, and cutting means carried by said cutting wheel in arcuately spaced positions for severing said strip at spaced intervals, each projection adapted to wedge against four adjacent containers to tighten said strip simultaneously adjacent to laterally spaced regions of the strip for severance.

9. A cutting wheel as set forth in claim 8 and further including means for respectively advancing said cutting means substantially perpendicular to said strip.

10. A cutting wheel as set forth in claim 8 wherein said wheel includes a plurality of spokes with said cutting means respectively mounted from at least certain of said spokes, each spoke being skewed relative to a respective radius whereby each spoke reaches a position perpendicular to said strip at a position upstream of a wheel radius perpendicular to said strip.

11. A cutting wheel as set forth in claim 8 wherein said strip comprises a plurality of parallel rings longitudinally interconnected by restricted sections, and wherein said cutting means comprises a like plurality of cutting blades.

12. A cutting wheel as set forth in claim 8 wherein each projection has a tapered enlargement thereon which wedges against a plurality of containers.

13. A cutting wheel as set forth in claim 12 wherein the enlargement is formed of plastic material.

14. A cutting wheel as set forth in claim 12 wherein each enlargement is nonsymmetrical.

* * * * *